US006934140B1

(12) United States Patent
Rober et al.

(10) Patent No.: US 6,934,140 B1
(45) Date of Patent: Aug. 23, 2005

(54) FREQUENCY-CONTROLLED LOAD DRIVER FOR AN ELECTROMECHANICAL SYSTEM

(75) Inventors: Stephen J. Rober, Arlington Heights, IL (US); Joshua S. Landau, Chicago, IL (US); Bernard Bojarski, Palatine, IL (US)

(73) Assignee: Motorola, Inc., Schaumburg, IL (US)

( * ) Notice: Subject to any disclaimer, the term of this patent is extended or adjusted under 35 U.S.C. 154(b) by 15 days.

(21) Appl. No.: 10/779,163

(22) Filed: Feb. 13, 2004

(51) Int. Cl.[7] ..... H01H 47/04
(52) U.S. Cl. ..... 361/154; 361/187
(58) Field of Search ..... 361/152, 153, 361/154, 185, 186, 187

(56) References Cited

U.S. PATENT DOCUMENTS

| | | | | |
|---|---|---|---|---|
| 4,388,587 | A | 6/1983 | Lamoth et al. | |
| 4,499,412 | A | 2/1985 | Locher et al. | |
| 5,020,772 | A | 6/1991 | Degenfelder et al. | |
| 5,191,504 | A * | 3/1993 | Narisawa et al. | 361/186 |
| 5,194,760 | A | 3/1993 | Braun et al. | |
| 5,222,011 | A | 6/1993 | Braun | |
| 6,052,005 | A | 4/2000 | Braun | |
| 6,133,764 | A | 10/2000 | Griffith et al. | |
| 6,232,809 | B1 | 5/2001 | Edwards | |
| 6,310,754 | B1 * | 10/2001 | Busato | 361/187 |
| 6,317,308 | B1 * | 11/2001 | Durif et al. | 361/143 |
| 6,324,045 | B1 * | 11/2001 | Dietzel et al. | 361/152 |
| 6,366,064 | B1 | 4/2002 | Reichard | |
| 6,381,116 | B1 * | 4/2002 | Durif et al. | 361/152 |
| 6,504,698 | B1 * | 1/2003 | Durif et al. | 361/152 |

* cited by examiner

*Primary Examiner*—Howard L. Williams
(74) *Attorney, Agent, or Firm*—Brian M. Mancini

(57) ABSTRACT

A frequency-controlled load driver circuit includes a steady-state and a transient operational mode. A switching driver switches a load current to a solenoid at a set switching frequency during a steady-state operational mode. An analog-to-digital converter (ADC) oversamples a sense resistor voltage an integer number of times within each period of the switching frequency. A control circuit sets the switching frequency of the driver during the steady-state operational mode by providing predetermined switching times. The control circuit disables switching during the transient mode. Dither can be applied during the steady-state mode.

19 Claims, 2 Drawing Sheets

10

FREQUENCY-CONTROLLED LOAD DRIVER FOR AN ELECTROMECHANICAL SYSTEM

FIELD OF THE INVENTION

The present invention relates to the field of load driver circuits in which circuitry is utilized to frequency control a switching current through a load.

BACKGROUND OF THE INVENTION

Electromechanical systems, such as electrically operated hydraulic valves for example, are subject to sticking when valves are left in the same position for a period of time. Consequently, when electricity is applied to the valve solenoid, to make it move, the valve may need to overcome a certain amount of friction from the sticking before it actually moves. As a result, the mechanical motion of the valve does not linearly track the applied current and instead follows a hysteresis curve. This can result in adverse operating condition in precision systems, such as vehicle transmissions for example. To combat this problem, the electromechanical system must be operated with a range of parameters dictated by the design of the components. One of these parameters is the frequency of the applied signals for control of the device. The frequency components of the electrical signals can be used to keep the electromechanical system in constant small-scale motion such that hysteresis is greatly reduced. This excitation component of the signal is known as "dither". In this way, the controlled current to the electrical load ensures the proper operation of the electromechanical system.

For electrical loads such as an inductance coil of an electromechanical system, such as a solenoid relay or valve actuator, many prior art circuits have controlled average current through the load inductance by controlling an amplitude of the drive current between two setpoints by use of a driver device connected in series with the load inductance. Typically, the current through the load inductance is sensed and the driver device is controlled to increase the load current when it is below a certain level and decrease the load current when it exceeds a certain level. In this manner, the solenoid current will oscillate repetitively between maximum and minimum levels (i.e. hysteresis) and thereby a desired average current level is achieved.

When the position of the mechanical system is to be switched, the setpoints are changed for the drive current to provide the transition. Due to the mass of the mechanical components and the electrical response of the electrical system, the transitional response of the electromechanical system is limited by a relatively constant slew rate. Moreover, the above current control scheme, based on electrical hysteresis control, only controls the maximum and minimum of the current waveform. Due to different electrical characteristics, the average or RMS current value of the waveform can shift significantly depending on the load. This can result in improper operation of the electromechanical system. Further, the above current control scheme does not provide a fixed frequency of operation.

One frequency problem with the prior art is that changing the amplitude of the setpoints will change the frequency of operation of the system due to the relatively constant slew rate. This is not a problem with larger valves, as the mechanical resonance of the system is much lower in frequency than the electrical response. However, newer systems have been requiring smaller and lighter valving, wherein the mechanical and/or hydraulic frequency response of the system approaches the electrical frequency response of the system. As a result, the dither frequency, and moreover the variable nature of the dither frequency, used to prevent sticking of the valve may actually feedback into the resonant mechanical and hydraulic systems, causing unpredictable excitation of the electromechanical system and systems coupled thereto.

In addition, the switching frequency is affected by the power supply (battery) level, wherein the switching frequency can change radically between low and high battery conditions. In this case, switching frequency can interfere with dither frequency. However, just providing a fixed frequency control would also be insufficient as the transient response of the system is still inadequate. Therefore, it would be desirable if the frequency of operation could be adapted easily as needed across the operating range of the electromechanical system.

What is needed is a frequency-controlled load driver current for an electromechanical system. It would also be of benefit to incorporate a fast transient response scheme for current control. It would also be advantageous to allow a simple change in the frequency of operation and to provide two modes of operation: one for steady state conditions and one for transient conditions.

BRIEF DESCRIPTION OF THE DRAWINGS

The features of the present invention, which are believed to be novel, are set forth with particularity in the appended claims. The invention, together with further objects and advantages thereof, may best be understood by making reference to the following description, taken in conjunction with the accompanying drawings, in the several figures of which like reference numerals identify identical elements, and wherein:

DETAILED DESCRIPTION OF A PREFERRED EMBODIMENT

The present invention provides a frequency-controlled load driver current for an electromechanical system, such as a valve actuator for example. A fast transient response scheme for current control with separate control modes for steady state and transient conditions is also provided. The present invention also allows a simple change in the frequency of operation over a range of operation of the electromechanical system.

Figure 1:
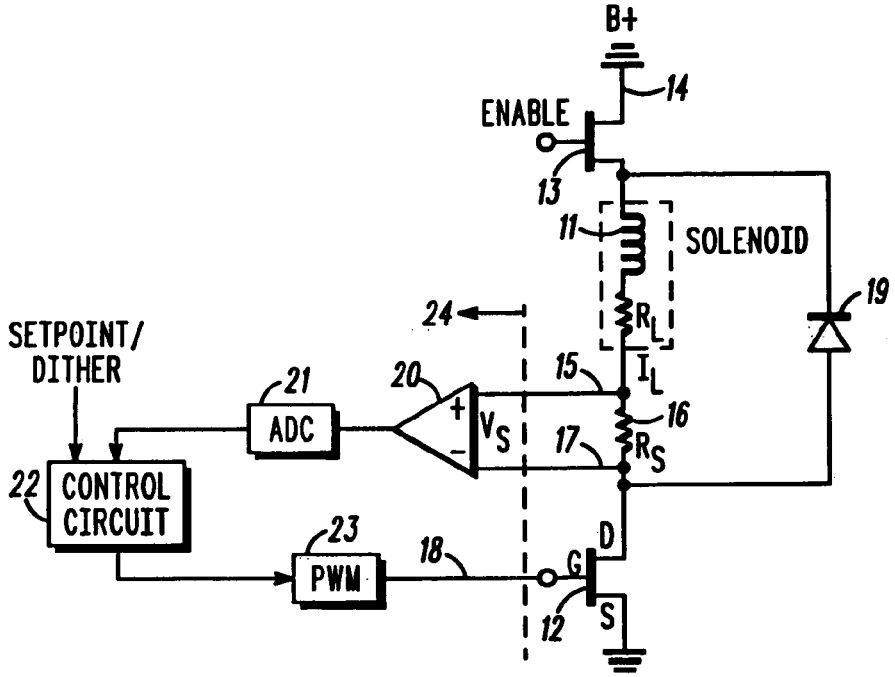
FIG. 1 is a simplified schematic diagram of a load driver circuit, in accordance with the present invention.

Referring to FIG. 1, a load driver circuit 10 is illustrated in which the load current $I_L$ through a desired load, comprising an inductive solenoid coil 11 (with internal resistance $R_L$), is controlled by a driver device 12, comprising an FET transistor for example, connected in series with the solenoid coil 11. One end of the solenoid coil 11 is coupled to a power supply terminal 14 at which a voltage potential B+ is provided. The other end of the solenoid coil 11 is connected to a positive sense terminal 15. A sensing resistor $R_S$ 16 is provided between the positive sense terminal 15 and a negative sense terminal 17 which is directly connected to a drain electrode D of the FET transistor 12. The transistor 12 has a source electrode S directly connected to ground and a control input electrode G, corresponding to the gate electrode of the transistor, connected to a control input terminal 18. A flyback or recirculation diode 19 is coupled between the B+ terminal 14 and the negative sense terminal 17 in the conventional fashion. An enable device 13, such as another FET transistor for example, can also be provided as shown, or provided through any other operational equivalent. The enable device 13 can also be provided as a gated control on input terminal 18, and the like.

The driver device 12 is shown located on a low side of the solenoid. However, it should be recognized that the driver device could also equally well be placed on a high side of the solenoid. In addition, it should be recognized that other driver devices or switching devices besides a FET could be used, and such devices and the like are envisioned herein.

The positive and negative sense terminals 15, 17 are connected to a comparator 20, which is connected to an analog-to-digital converter (ADC) 21. The ADC samples the signal from the comparator 20 and inputs these samples to a control circuit 22. The control circuit 22 is coupled to the driver device 12 to control the current through the solenoid coil 11. A pulse width modulator (PWM) 23, under control of the control circuit, is used to control the current drive, $I_L$, using a fixed frequency operation, in accordance with the present invention and as will be explained below.

The comparator 20, ADC 21, PWM 23 and control circuit 22 can be co-located on an integrated circuit 24. The switching transistor 12 and the current sensing resistor 16 are not shown within the integrated circuit 24 since these are high power components and probably cannot be economically implemented in a single integrated circuit which can contain other electronics. If possible, the lockout/enable circuit 13 can also be implemented in the integrated circuit.

Essentially, in response to high or low logic states provided at the control input terminal 18, the transistor 12 is switched on or off and this switching controls the load current $I_L$ in the solenoid coil 11. The magnitude of this load current is sensed by a load current signal, corresponding to a differential sense voltage $V_s$ that is developed across the sense resistor 16. The magnitude of the signal $V_s$ varies directly in accordance with the magnitude of the load current through coil 11. The differential sense voltage $V_s$ is provided to a comparator 20 whose output is sampled by the analog-to-digital converter 21 (ADC). The control circuit 22 inputs the information from the ADC and uses this information to provide an input signal at the terminal 18 to control the drive current. Preferably, a pulse width modulator 23 (PWM) is used as a control signal for the device driver 12. The duty cycle of the PWM is changed by the control circuit to control the desired average load current.

Figure 2:
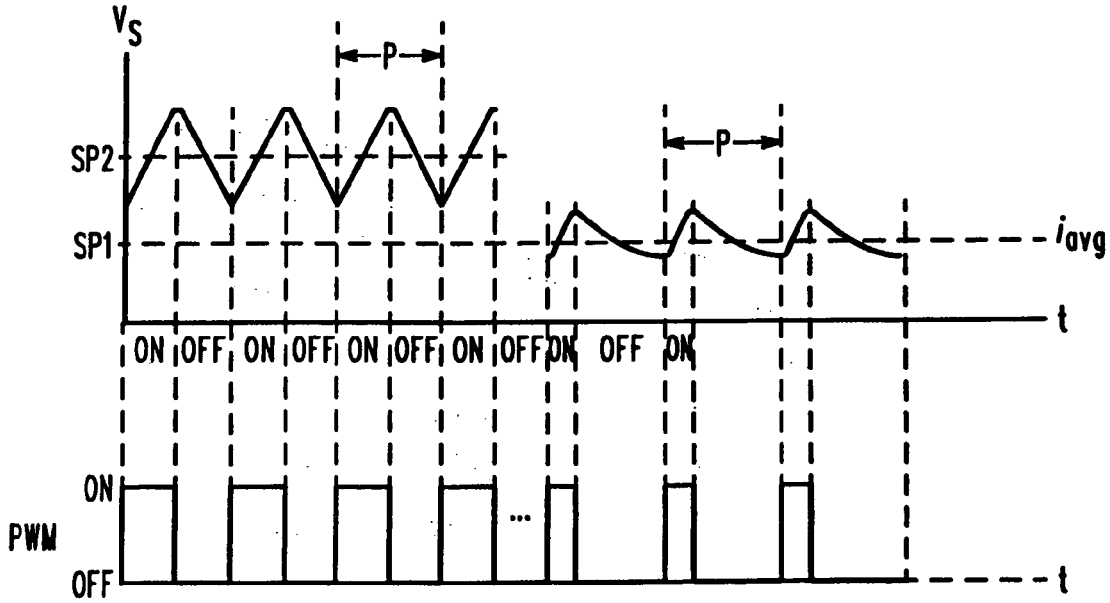
FIG. 2 is a graphical representation of a steady-state operational mode of the circuit of FIG. 1.

Referring now to FIG. 2, a steady-state operational mode of the load driver circuit 10, in accordance with the present invention, will be briefly explained. FIG. 2 is a graph of the sense voltage $V_s$ versus time after a steady state condition has been achieved during which a desired average load current is provided. In the present invention, a frequency of operation is chosen that is not in resonance with a known mechanical and/or hydraulic resonance of the electromechanical system. Typically, this results in a frequency that is higher than the mechanical and/or hydraulic resonance.

The pulse width modulator 23 controls the average current by changing the duty cycle. As shown in FIG. 2, a fifty-percent duty cycle is shown first followed by a twenty-five percent duty cycle. These duty cycle values correspond to the output of the control logic when two average current setpoints SP2 and SP1, respectively, are input to the system, where SP2 is a higher value than SP1. In both cases the period, as driven by the PWM, remains the same. The duty cycle of the PWM output changes due to the ramp-up, ramp-down, voltage flyback, and electrical decay of the currents in the solenoid inductor. It should be recognized, that the waveform is not necessarily symmetric and can be skewed, due to the ramp-up and ramp-down limitations, as shown for the twenty-five percent duty cycle portion. Preferably, the period P (i.e. frequency) is fixed for any defined electromechanical system. However, it is envisioned that a variable frequency could be provided for those electromechanical system that could benefit therefrom.

Referring to FIGS. 1 and 2, for values of time before $t_{ON}$, the switching transistor 12 is maintained in a fully conductive state (ON). This results in the ramping up or increasing of load current through the load inductance coil 11. The current through the coil 11 cannot increase instantaneously due to the RL response of the solenoid and this is the reason for the ramping up of the current sense signal $V_s$ due to the slew rate of the solenoid as shown in FIG. 2. When the time on has exceeded $t_{ON}$, the switching transistor 12 will be turned off resulting in a corresponding decrease or ramping down of the load current, while the current is recirculated through the diode 19. This will continue until the period of a single switching cycle ends as shown in FIG. 2. When this occurs, the transistor 12 will again be switched on resulting in a repetition of the previously described cycle. The end result is that an average current, $i_{avg}$, through the inductive load 11 is maintained. It should be recognized that, although the load driver device 12 in this example is shown as a switching FET transistor that is switched between completely ON or OFF states, other driver configurations could also be used having partially conducting states.

In accordance with the present invention, load driver current control is separated into two components: a steady-state control mode and a transient control mode. The transient control only operates where the position of the solenoid is to be changed and if the absolute difference between the new setpoint value and the old setpoint value is greater than a pre-programmed threshold. This threshold is programmable and is calibrated based on load characteristics. Otherwise the steady-state control mode is used. Each mode will be described separately, below.

Referring back to FIG. 1, in steady-state operation, the load current, $I_L$, is read via the differential voltage across a low-side sense resistor, $R_s$. The comparator 20 amplifies the signal appropriately to be fed into the ADC 21, which oversamples the signal. The ADC 21 is programmed to take an integer number of samples from the comparator 20 within one period, P, of the chosen operating frequency. Preferably, this integer is $2^N$ where N is an integer. For example, thirty-two samples can be taken during each frequency period. As a result, current measurement is performed by equally-spaced analog-to-digital samples. In addition, the number of samples (e.g. thirty-two) remains the same for any chosen frequency of operation, which is accomplished by using a global clock divider (not shown) for sampling and control. This is significant as it provides a more robust controller, inasmuch as the control constants work over a larger range of frequencies, as the sampled values and output are all scaled proportionately. Fixing the number of sample also avoids prior art problems where an operating frequency could change, resulting in too many samples within one period and not enough samples in the next, which can result in unstable operation. Preferably, the ADC uses a bandgap reference (not shown).

The control circuit 22 sums the thirty-two samples over each period for more stable operation. This is different from the prior art when only one sample is taken per period. An RMS or analogous technique can be used to further smooth the sample result. The control circuit 22 can then process the summed samples to instruct the PWM 23 to provide the proper duty cycle to operate the device driver 12. The control circuit can scale the results in accordance with the chosen fixed frequency of operation and choose the proper setpoints.

The control logic is activated before the rising edge of the PWM. The logic can be started directly after the last A/D sample is taken for the period to ensure adequate calculation time before the rising edge of the PWM, so that a new duty cycle may be calculated before the rising edge occurs.

Optionally, the control circuit can auto-zero the current measurements periodically. In addition, noise in the measurements can be reduced by using anti-aliasing and other low pass filtering.

The operation of the load driver circuit 10, in regard to a transient operation mode, and in relation with the steady-state operational mode, will now be discussed. Transient mode occurs when there is a large motion of the solenoid required. In particular, if the difference between a new setpoint and the old setpoint is greater than the pre-programmed threshold, then the system enters the transient mode after the beginning of the next period of control. If the difference between the new setpoint and the old setpoint is not greater than the pre-programmed threshold, then the system remains in the stead-state control mode and the control circuit control loop continues to function. This is also true if the transient control mode is disabled.

In particular, upon entering transient mode, the control circuit suspends operation of the dither control loop (i.e. controlling the duty cycle output of the PWM), as explained above for the operation of the steady-state mode, and directs the PWM 23 to apply full ON or OFF signals to the device driver 12, while changing the setpoint to SP3. The benefit of transient mode is the fast transient response available in view of a large change in setpoint. An improperly tuned control loop in the steady-state mode may not go to 100% duty cycle to achieve the fastest response possible. This transient-mode function forces the switch ON or OFF to achieve the minimum transition time possible.

Figure 3:
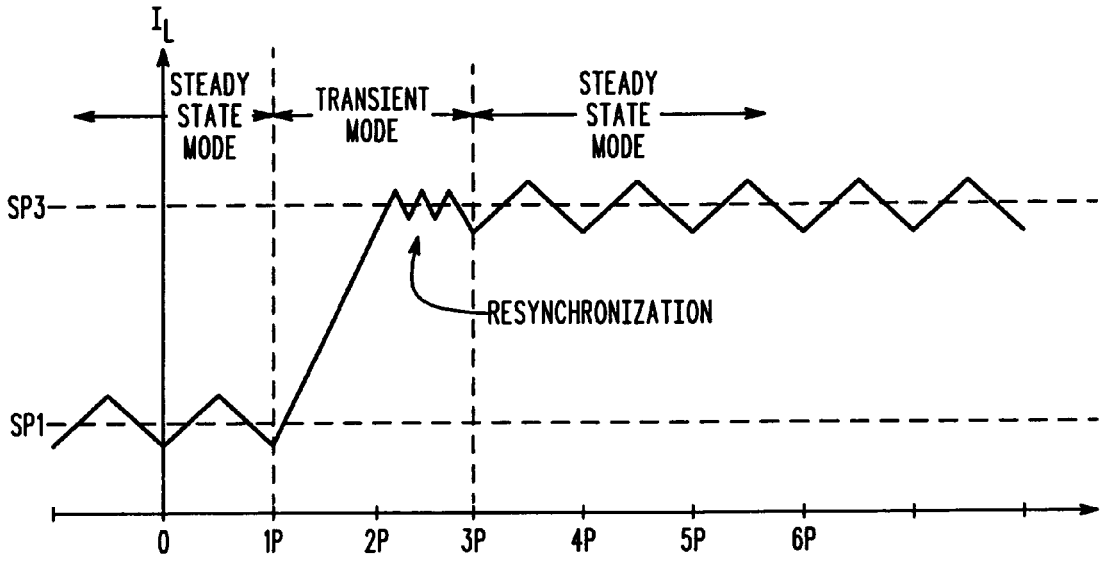
FIG. 3 is a graphical representation of transitions between steady-state and transient operational modes of the circuit of FIG. 1.

Referring to FIG. 3, a switching frequency of period P is being applied in a steady-state mode at SP1. Before time 1P the control circuit receives an external command to move the valve, requiring a change to transient mode during the next period (1P–2P) and calling for an increase in load current. In order to maintain phase, transient mode is entered at a point where the ON portion of the PWM duty cycle corresponds to a call for increasing current. Correspondingly, if a transient decrease in load current were called for, the transient mode would occur at a point where the OFF portion of the PWM duty cycle corresponds to a call for decreasing current in the next period.

During this time dither and switching capabilities are suspended. When the new setpoint SP3 is reached, the device simply turns off the switch when $V_s$ is above the threshold and turns on when $V_s$ is below the threshold. This decision is made each time the A/D sample is taken. At a set number of A/D samples before the beginning of the next period (in this example four samples), the gate turns off in preparation of the next fixed period steady-state control. Switching in this method once the threshold is reached minimizes the chances for overshoot of the system. However, steady-state mode will not be entered until the start of the next available period to ensure the proper phasing between controlled channels. When the control logic for steady-state is reinitialized, the integrator of the controller will be reinitialized with a preset value to initialize the controller at the new steady-state level. If the new setpoint is reached before entering the next period (3P) dither will be enabled to not only keep the valve free to move but also to allow the system to resynchronize such that steady-state mode can be enter in-phase. The entering and exiting of modes in-phase eliminates electrical system requirements for instantaneous current changes which could not be provided.

Figure 4:
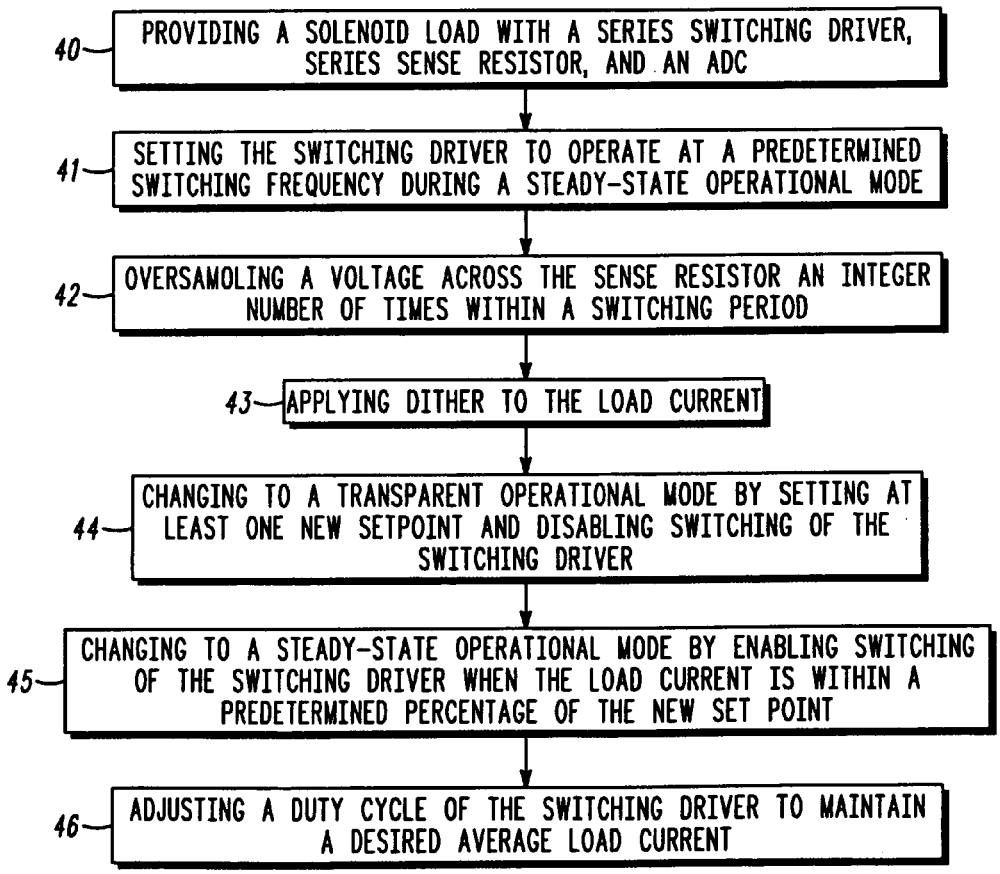
FIG. 4 flow chart for a method of driving a circuit, in accordance with the present invention.

Referring to FIG. 4, the present invention also includes a method for controlling a load driver circuit. The method comprising a first step 40 of providing a solenoid load with a series switching driver and a series sense resistor and an analog-to-digital converter coupled thereto. A next step 41 includes setting the switching driver to operate at a predetermined switching frequency during a steady-state operational mode by determining appropriate switching times. A next step 42 includes oversampling a voltage across the sense resistor due to a load current of the solenoid an integer number of times within a switching period. Preferably, the number of samples taken by the ADC per period is $2^N$ where N is an integer.

A next step 43 includes applying dither to the load current. The dither may be applied at a same or different frequency than the switching frequency. If a different frequency is desired, dither is applied by varying at least one of the setpoints of the switching frequency at the desired dither frequency.

A next step 44 includes changing to a transient operational mode by setting at least one new setpoint and disabling switching of the switching driver. Preferably, dither is also disabled at this point.

A next step 45 includes changing to a steady-state operational mode by enabling switching of the switching driver when the load current is within a predetermined percentage of the new setpoint.

It is desirable that both of the changing steps 44, 45 include maintaining the operating phase of the load driver circuit when changing between the steady-state mode and the transient modes. For example, the change from the steady-state mode to the transient mode can occur when the current is crossing a local zero point about the average current of the steady-state mode. And when changing to a steady-state operational mode from a transient mode, dither is reinstated to the load current, when the load current is within a predetermined percentage of the new setpoint, for resynchronization of the current until a start of a next period, whereupon the switching frequency is also reinstated in phase with the switching control logic.

A further step 45 includes adjusting a duty cycle of the switching driver to maintain a desired average of the load current during the steady-state mode.

It should be recognized that the present invention can find application in many electrically driven mechanical and/or hydraulic systems. While specific components and functions of the present invention are described above, fewer or additional functions could be employed by one skilled in the art and be within the broad scope of the present invention. The invention should be limited only by the appended claims.

What is claimed is:

1. A frequency-controlled load driver circuit comprising:

a solenoid load connected with a series sense resistor;

a switching driver coupled to the load, the driver operable to switch a load current at a predetermined switching frequency during a steady-state operational mode;

an analog-to-digital converter (ADC) coupled to the sense resistor for oversampling a voltage thereacross, wherein the ADC oversamples the sense resistor voltage $2^N$ times, where N is an integer, within each period of the predetermined switching frequency; and a control circuit coupled to the ADC and driver, the control circuit is operable to set the switching frequency of the driver during the steady-state operational mode by providing predetermined switching times, and the control circuit is also able to disable switching during a transient operational mode.

2. The circuit of claim 1, wherein the control circuit is operable to apply a dither to the load current during steady-state conditions.

3. The circuit of claim 2, wherein a frequency of the applied dither is different than the switching frequency and is applied to the load current by varying the switching frequency at a desired dither frequency.

4. The circuit of claim 2, wherein the dither frequency is the same as the switching frequency.

5. The circuit of claim 1, wherein the control circuit is operable to adjust a duty cycle of the switching driver to maintain a desired average of the load current.

6. The circuit of claim 1, wherein the control circuit is operable to maintain the operating phase of the load driver circuit when switching between steady-state and transient modes.

7. A frequency-controlled load driver circuit comprising:

a solenoid load connected with a series sense resistor;

a switching driver coupled to the load, the driver operable to switch a load current at a predetermined switching frequency during a steady-state operational mode;

an analog-to-digital converter (ADC) coupled to the sense resistor for oversampling a voltage thereacross, wherein the ADC oversamples the sense resistor voltage $2^N$ equally-spaced times, where N is an integer, and sums the samples within each period of the predetermined frequency; and a control circuit coupled to the ADC and driver, the control circuit is operable to set the switching frequency of the driver during the steady-state operational mode by providing predetermined switching times, and the control circuit is also operable to apply dither to the load current and to disable switching and dither during a transient operational mode.

8. The circuit of claim 7, wherein the dither frequency is different than the switching frequency and is applied to the load current by varying the switching frequency at a desired dither frequency.

9. The circuit of claim 7, wherein the control circuit is operable to adjust a duty cycle of the switching driver to maintain a desired average of the load current.

10. The circuit of claim 7, wherein the control circuit is operable to maintain the operating phase of the load driver circuit when changing from the steady-state mode to the transient mode.

11. The circuit of claim 7, wherein the control circuit is operable to change the load driver circuit from the steady-state mode to the transient mode by setting at least one new switching setpoint and disabling dither, and the control circuit is operable to switch from transient mode to steady-state mode when the load current is within a predetermined percentage of the new setpoint.

12. The circuit of claim 11, wherein the control circuit is operable to maintain the operating phase of the load driver circuit when switching between transient and steady-state modes, wherein when the load driver circuit is being switched from transient mode to steady-state mode, the control circuit is operable to reinstate a dither frequency to the load current for resynchronization until a start of a next period, whereupon the switching frequency is also reinstated in phase with the control logic.

13. A method for controlling a frequency-controlled load driver circuit, the method comprising the steps of:

providing a solenoid load with a series switching driver and a series sense resistor and an analog-to-digital converter coupled thereto;

setting the switching driver to operate at a predetermined switching frequency during a steady-state operational mode by determining appropriate switching times;

oversampling a voltage across the sense resistor due to a load current of the solenoid by the analog-to-digital converter $_2$N of times, where N is an integer, within each period of the predetermined switching frequency;

applying dither to the load current;

changing to a transient operational mode by disabling switching of the switching driver; and changing to a steady-state operational mode by enabling switching of the switching driver at predetermined switching times to set the switching frequency of the switching driver.

14. The method of claim 13, wherein the applying step includes applying a frequency of the dither different than the switching frequency by varying the switching frequency at a desired dither frequency.

15. The method of claim 13, further comprising the step of adjusting a duty cycle of the switching driver to maintain a desired average of the load current.

16. The method of claim 13, wherein the changing steps include maintaining the operating phase of the load driver circuit when changing between the steady-state mode and the transient modes.

17. The method of claim 13, wherein the changing to a transient operational mode includes disabling the dither.

18. The method of claim 13, wherein the changing to a steady-state operational mode includes reinstating dither to the load current for resynchronization until a start of a next period, whereupon the switching frequency is also reinstated in phase with control logic.

19. The method of claim 13, wherein the applying step includes applying a frequency of the dither the same as the switching frequency.

* * * * *